US007481502B2

(12) United States Patent
Ortiz et al.

(10) Patent No.: US 7,481,502 B2
(45) Date of Patent: Jan. 27, 2009

(54) OFFICE DESK FRONT PANEL AND HARDWARE ADAPTED FOR 90-DEGREE ROTATION FROM VERTICAL STORAGE POSITION INTO A HORIZONTAL WORKSPACE POSITION

(76) Inventors: Isabella Victoria Ortiz, 7005 Vista del Arroyo Ave. NE., Albuquerque, NM (US) 87109; Luis M. Ortiz, 7005 Vista del Arroyo Ave. NE., Albuquerque, NM (US) 87109

( * ) Notice: Subject to any disclaimer, the term of this patent is extended or adjusted under 35 U.S.C. 154(b) by 112 days.

(21) Appl. No.: 10/992,280

(22) Filed: Nov. 18, 2004

(65) Prior Publication Data

US 2005/0104489 A1 May 19, 2005

Related U.S. Application Data

(60) Provisional application No. 60/523,269, filed on Nov. 18, 2003.

(51) Int. Cl.
*A47B 77/10* (2006.01)

(52) U.S. Cl. ..... 312/194; 312/314; 312/317.3; 108/79

(58) Field of Classification Search ..... 312/281, 312/282, 317.1, 317.2, 317.3, 322, 325, 280, 312/194–196, 241, 277, 313–316; 108/40, 108/65, 68, 139, 140, 134, 69, 77–79, 33
See application file for complete search history.

(56) References Cited

U.S. PATENT DOCUMENTS 313,768 A * 3/1885 Pringle et al. ..... 312/289
889,407 A * 6/1908 Organ ..... 294/67.1
1,347,025 A * 7/1920 Gloppe ..... 312/222
1,674,883 A * 6/1928 Broberg ..... 312/316
1,776,551 A * 9/1930 Cooley ..... 108/63
1,840,249 A * 1/1932 Palumbo ..... 108/78
2,010,855 A * 8/1935 Fuller ..... 108/63
2,319,613 A * 5/1943 Lichtstern et al. ..... 312/240
2,472,903 A * 6/1949 Kamholtz ..... 108/69
2,575,725 A * 11/1951 McKay ..... 312/312
2,665,180 A * 1/1954 Poole ..... 108/83
2,679,443 A * 5/1954 Gaines ..... 312/241
2,714,743 A * 8/1955 Lochner ..... 16/364
2,958,304 A * 11/1960 Arbib ..... 112/260
3,306,690 A * 2/1967 Gibson et al. ..... 312/208.5
3,340,827 A * 9/1967 Sims ..... 108/77
4,068,551 A * 1/1978 Kreitz ..... 83/471.3
4,301,744 A * 11/1981 Walter ..... 108/77
4,310,207 A * 1/1982 Adams, Jr. ..... 312/314
4,856,435 A * 8/1989 Larson ..... 108/134

(Continued)

*Primary Examiner*—Janet M Wilkens

(57) ABSTRACT

Front decorative panel can be moved from its storage position directly in front of the desk into a deployed, horizontal work space position near or at the height of the desk's top. When deployed the panel provides additional workspace arranged to run in parallel with the front of the desk or perpendicular to the desk top as a long extension. At least one support member that can be moved into position beneath the front panel after horizontal deployment to keep the front panel in its upright, horizontal position. Control hardware enables the front panel to be physically manipulated into deployed or storage positions by a user. A safety mechanism associated with the control hardware can restrict the speed or movement of the front panel. The front panel can be used by meeting collaborators when deployed and enable the maintenance of open office space when the front panel is stored.

3 Claims, 7 Drawing Sheets

U.S. PATENT DOCUMENTS 5,403,082 A * 4/1995 Kramer ..... 312/249.9
5,863,282 A * 1/1999 Moossun ..... 482/148
6,053,587 A * 4/2000 Boerder ..... 312/249.12
6,805,417 B2 * 10/2004 Kocienski ..... 312/314

* cited by examiner

OFFICE DESK FRONT PANEL AND HARDWARE ADAPTED FOR 90-DEGREE ROTATION FROM VERTICAL STORAGE POSITION INTO A HORIZONTAL WORKSPACE POSITION

INVENTION PRIORITY

The present invention is a continuation of and claims priority to provisional patent application no. 60/523,269 entitled "Office desk including front panel and hardware adapted for 90-degree rotation from vertical storage position into horizontal workspace position and support member deployable from storage position into support position beneath deployed front panel," which was filed Nov. 18, 2003.

FIELD OF THE INVENTION

The present invention is generally related to office furniture. More particularly, the present invention is related to a desk adapted with a panel for the provision of additional workspace, and is also related to conference room and office furnishings.

BACKGROUND

Executive office space has shrunk over the years because of enterprise cost cutting and the move to flatten organizational structures. With the reduction in office space, and in particular personal offices, executives, managers and professionals are left with less space to conduct meaningful multi-party conferences or meetings. Conference rooms are generally available for use in modern office designs; however, scheduling time for use of such space is burdensome and usage is typically limited in duration. Conference rooms are also only typically reserved for a few hours, at most, and participants are required to remove their materials, work product or belongings immediately after a session ends so that subsequent participants on a conference room schedule can occupy the space.

Although many office meetings only involve a few participants, most common offices will likely be crowded if a small conference room table were added to space that may already be occupied by a desk, credenza, bookshelves and file cabinets. Furthermore, the additional table would typically not be in continuous use for collaborative sessions and, therefore, may be in the way or, worse, can serve as a work pile collector when it is not being utilized for its intended purpose.

It would be desirable, therefore, for private office furnishing to accommodate small conferences/meetings wherein only 2-4 visiting participants are involved. The present inventors believe their invention will accommodate tight office space situations where collaboration space is occasionally needed but not presently served by conference room reservation, addition furniture (e.g., small conference table) or modular furniture.

SUMMARY OF THE INVENTION

The invention modifies the common desk to provide additional workspace. A desk can be adapted with a stored panel that can be easily deployed from and stored against traditional office furniture formats. In particular, it is a feature of the present invention to provide a standard desk with a front decorative panel that can be rotated from its bottom edge, 90-degrees upward from its storage position into a deployed, horizontal position.

It is another feature of the present invention that the upper edge of the front panel remains located nearest the front of the desk whether in deployed or stored positions. The front panel is thereby converted into additional workspace running parallel with the front of the desk for meeting collaborators.

It is another feature of the present invention to provide a hinge system for the front panel that allows the front panel, when in the storage position, to remain attached near its top near the front of the desk wherein the hinge system is securely mounted to the desk underneath the desktop. The hinge system also enables the front panel to be swung (e.g., rotated) into horizontal position as the bottom of the panel is swung upward ninety degrees.

In an alternate embodiment, it is a feature of the present invention to provide a standard desk with a front decorative panel that can be swung (e.g., horizontally rotated) from its bottom edge upward 90-degrees from its storage position and also turned (e.g., vertically rotated) at one end 90 degrees outward from the one end's storage position near the front of the desk, into a deployed, horizontal position wherein one end of the panel is located and touching near the front of the desk and the opposite end is located furthest away from the front of the desk. The front panel is thereby converted into additional workspace running lengthwise (e.g., perpendicular as if to form the stem of the letter "T") from the front of the desk for use by meeting collaborators.

Another feature of the present invention is to provide at least one support member that can be moved into position beneath the front panel after horizontal deployment to keep the front panel in its upright, horizontal position.

It is another feature of the present invention to provide at least one support member that can be stored when not in use within the desk, and the at least one support member can be slide into position from its storage location into contact beneath the bottom surface of the front panel.

It is yet another feature of the present invention to provide control hardware as a safety mechanism that limits the speed and difficulty over which the front panel can be moved from its deployed, horizontal position into its vertical storage position.

These and other features and advantages of the invention will be further understood and appreciated after reading the following description and the appended claims and after reviewing all the drawings.

DETAILED DESCRIPTION OF PREFERRED EMBODIMENTS

Figure 1:
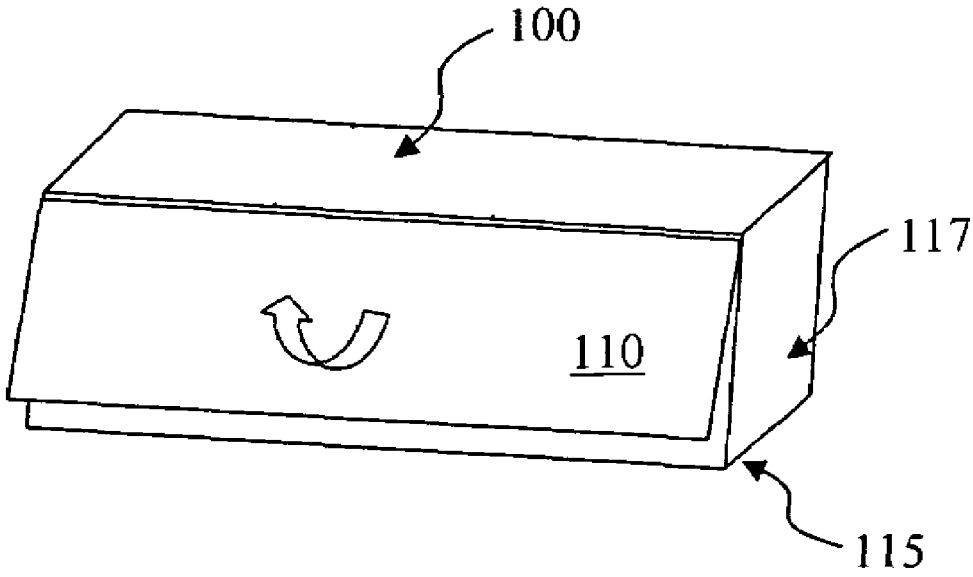
FIG. 1 illustrates a three point perspective drawing of a desk in accordance with the present invention wherein the front panel is being partially deployed from its storage position in front of the desk as indicated by the arrow.

Referring to FIG. 1, a three point perspective drawing of office furnishing in accordance with an embodiment of the present invention is shown. As shown in FIG. 1, an office desk 100 includes a front panel 110 that can be maintained in a vertical storage position and as decorative panel directly in front of the main body 117 of the desk 100. If additional workspace is required by meeting collaborators, the front panel 110 can be deployed by swinging (rotating) the bottom edge of the front panel 110, as shown by the arrow, upward and away from its stored position near the bottom 115 of the desk 100 into a fully deployed, horizontal position.

Figure 2:
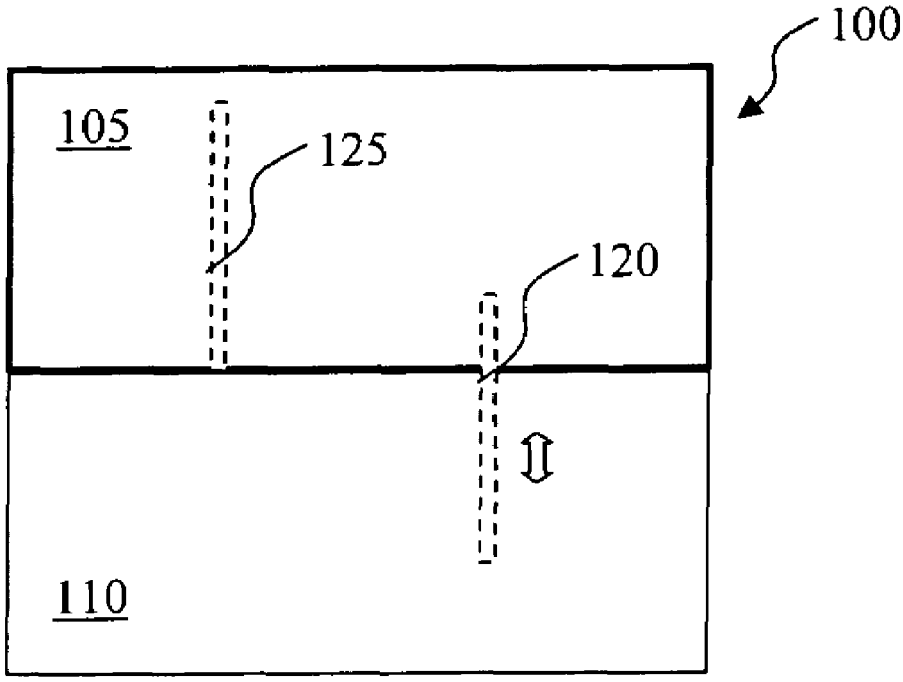
FIG. 2 illustrates a top view of a desk in FIG. 1, the front panel in its fully deployed position wherein the front panel is situated parallel with the front of the desk, and one support member is shown in a stored position within the desk while another support member is shown deployed underneath the front panel as support for the front panel.

Referring to FIG. 2, illustrated is a top view of the desk 100 and front panel 110, with the front panel deployed. As shown by the dashed lines, at least one support member 120 is movable from a storage position inside the desk 100 to a deployed position underneath, and supporting, the front panel 110. A second support member 125 is shown in its storage position. During use of the front panel 110 as workspace, both support members 120/125 will normally be used in their fully deployed, supporting position underneath the front panel 110.

Figure 3:
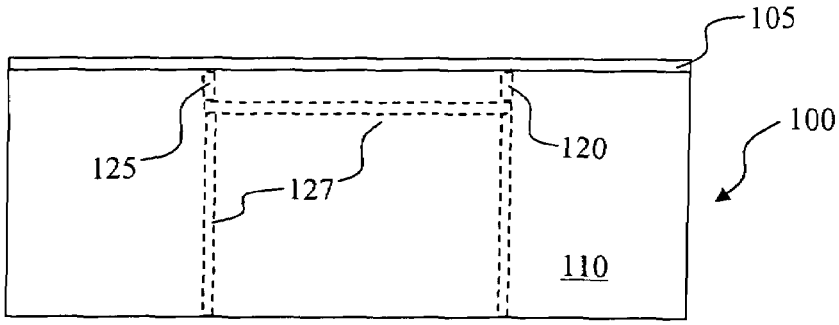
FIG. 3 illustrated a front view of the desk with the panel in its stored, vertical position and support members are shown by dashed lines in storage position within the desk and underneath the desk top.

Referring to FIG. 3, a front view of the desk 100 is shown with the front panel 110 in storage position. The front panel will preferably be made of similar material (e.g., wood) as the desk's top 105. Also shown in FIG. 3 is the general location of support members 120 and 125 behind the front panel 110. Also within desk 100, a support structure 127 located beneath the support members 120/125 near the inside front panel 107 of the desk 100 can provide support for the support members 120/125 when deployed (extended from the desk and supporting front panel 110). The support structure 127 will be secured to and form part of the desk 100 and together with the desk 100 will provide ballast (weight) to offset the weight or downward force that may be applied on the front panel 110 when it is deployed and in use.

Figure 4:
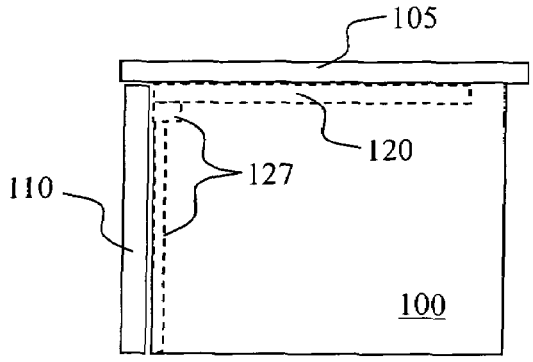
FIG. 4 illustrates a side view of the desk with the front panel situated in its storage position at the front of the desk, and a support member is shown by dashed lines located under the desk top within the desk.

Referring to FIG. 4, a side view of the desk 100 is shown with the front panel 110 in its storage position. Also shown in FIG. 4 is the general location of support members 120/125 within the desk 100, underneath the desk top 105 and supported by support structure 127 near the inside, front of desk 100.

Figure 5:
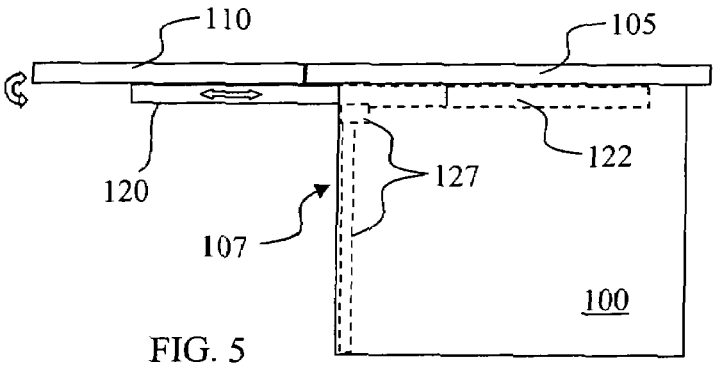
FIG. 5 illustrates another side view of the desk with the front panel deployed in an upright, horizontal position at the front of the desk, and a support member is also shown by solid and dashed lines to be located under the front panel as support and partially located within the desk even when deployed.

Referring to FIG. 5, a side view of desk 100 is shown with the front panel 110 fully deployed in a horizontal position adjacent the desk top 105. Also shown in FIG. 5 is support member 120 extended from its storage location 122 in the desk 100 to a support position beneath front panel 110.

Figure 6:
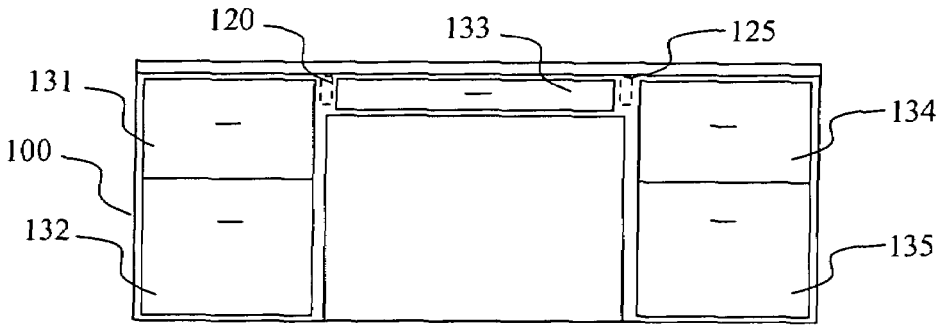
FIG. 6 Illustrates a rear view of the desk wherein drawers are located in standard positions at the rear of the desk and support members are shown by dashed lines in position between middles and side drawers within the desk.

Referring to FIG. 6, a rear view of the desk 100 is illustrated wherein drawers 131-135 are located in standard positions at the rear of the desk 100 and support members 120 and 125 are shown by dashed lines in position between middle drawer 133 and side drawers 131 and 134 within the desk.

Figure 7:
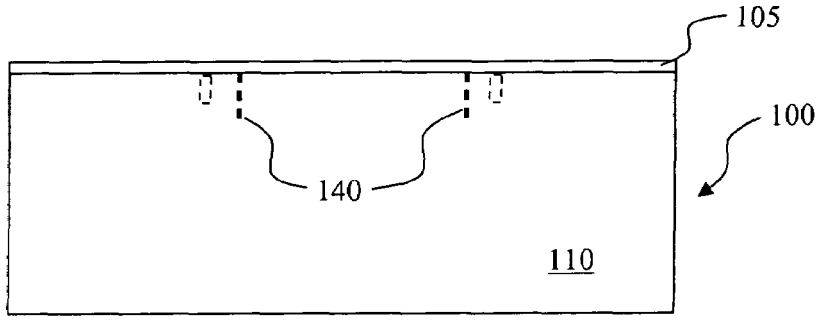
FIG. 7 illustrates another embodiment of the present invention wherein the front of the desk is shown and dashed lines also show the position of support/hinge hardware mounted to the desk and front panel in a manner that allows and guides the front panel's movement.

FIG. 7 illustrates another embodiment of the present invention wherein the front of the desk 100 is shown and dashed lines also show the position of control hardware 140 securely mounted to the desk top 105 within the desk 100 and also securely mounted to the inside/underneath surface of front panel 110 or in any other manner known in the art that will enable the front panel's 110 movement to be controlled and guided during operation.

Figure 8:
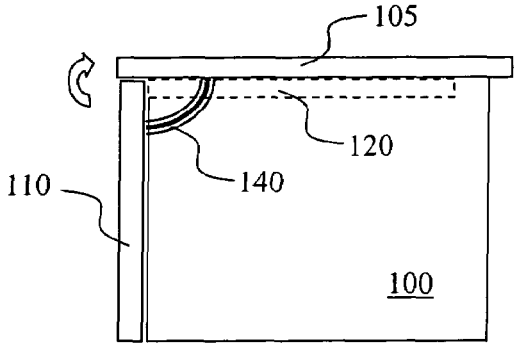
FIG. 8 illustrates a side view of the desk with the front panel situated in its storage position at the front of the desk, and hinge hardware and a support member are also shown located in storage position under the desk top within the desk.

FIG. 8 illustrates a side view of the desk 100 with the front panel 110 situated in its storage position at the front of the desk 100, and control hardware 140 and a support member 120 are also shown located in their respective storage position under the desk top 105 within the desk 100.

Figure 9:
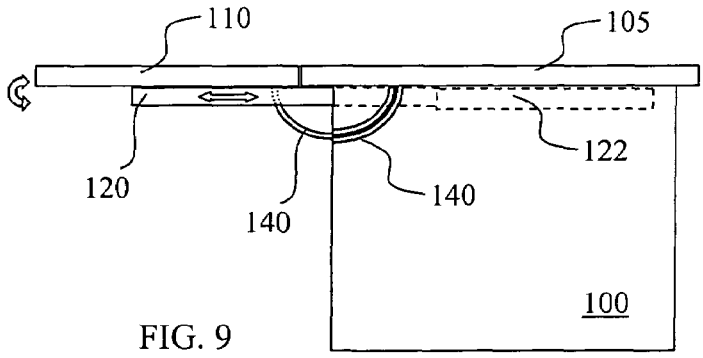
FIG. 9 illustrates another side view of the desk with the front panel deployed in an upright, horizontal position at the front of the desk, a support member is shown also shown by solid and dashed lines to be located under the front panel as support and partially located within the desk even when deployed, and the hinge hardware is shown extended while lending support to the front panel near the front of the desk.

Referring to FIG. 9, illustrated is another side view of the desk 100 for FIG. 8 with the front panel 110 deployed in an upright, horizontal position at the front of the desk 100. A support member 120 is also shown by solid and dashed lines located under the front panel 110 and providing support to the front panel 110, while the support member 120 remains partially located within the desk 100 to maintain stability over the front panel 110 when deployed. It should be appreciated that the control hardware 140 can be provided in the form of spring-loaded hinges or sliding brackets, which are well known to be able to control and support heavy swinging or rotating panels (e.g., doors). Support structure 127 (as shown in FIGS. 4 and 5) are not shown in order to simplify FIGS. 8 and 9).

Figure 10:
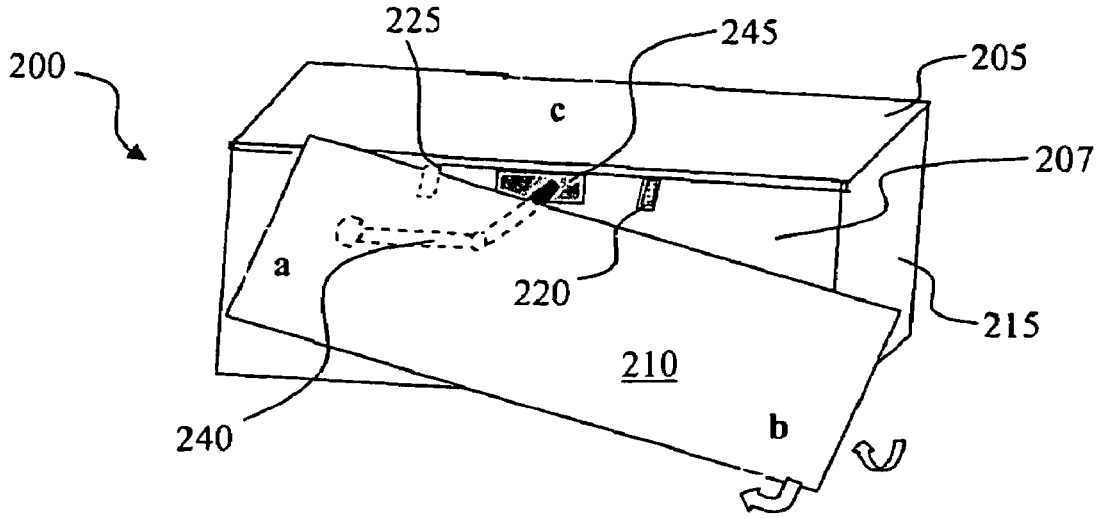
FIG. 10 illustrates a three point perspective drawing of an alternate embodiment of the present invention showing a desk wherein the front panel is being partially deployed at end "b" with the assistance of associated control hardware from its storage position in front of the desk as indicated by the two arrows (e.g., pulled away and rotated at end "b").

FIG. 10 illustrates a three point perspective drawing of office furnishing in accordance with an alternate embodiment of the present invention. A desk 200 is shown with a front panel 210 is partially deployed. The front panel 210 is deployable to a horizontal, rotated position with respect to the desk top 205. As indicated by the arrows, the front panel end "b" is pulled away from the side of the desk 215 while at the same time the front panel 210 is rotated at end b. End b of the panel pulled away from the desk 200 and rotated at end "b" until end "a" of the panel is in position parallel with the front edge of the desk top 205 as indicated by letter "c". The front panel 210 is supported and its movement controlled by control hardware 240 mounted at one end to the bottom surface of the front panel near end "a" and secured at the opposite end to internal structure (e.g., bottom side of desktop 205) of the desk 200.

A slot 245 can be provided within the inside panel 207 of the desk. The slot 245 should be adequately sized to enabled control hardware 240 to move with the front panel 210 during operation. Also shown is support member 220 within its storage slot. Dashed lines also indicate the general location of support member 225. Together, the front panel 210 and control hardware 240 should enable a single user to easily and safely maneuver the front panel 110 into deployed and storage positions. The user should also be able to easily maneuver the support members into position underneath the front panel 210 and into storage within the desk 200. Spring loaded, hydraulic and pneumatic hardware are well known in the mechanical art (e.g., storm door air shock, garage door control springs, Murphy bed control hardware, movement sprockets), therefore it should be appreciated that known techniques of controlling large objects mechanically can be implemented as part of the control hardware 140 described herein.

Figure 11:
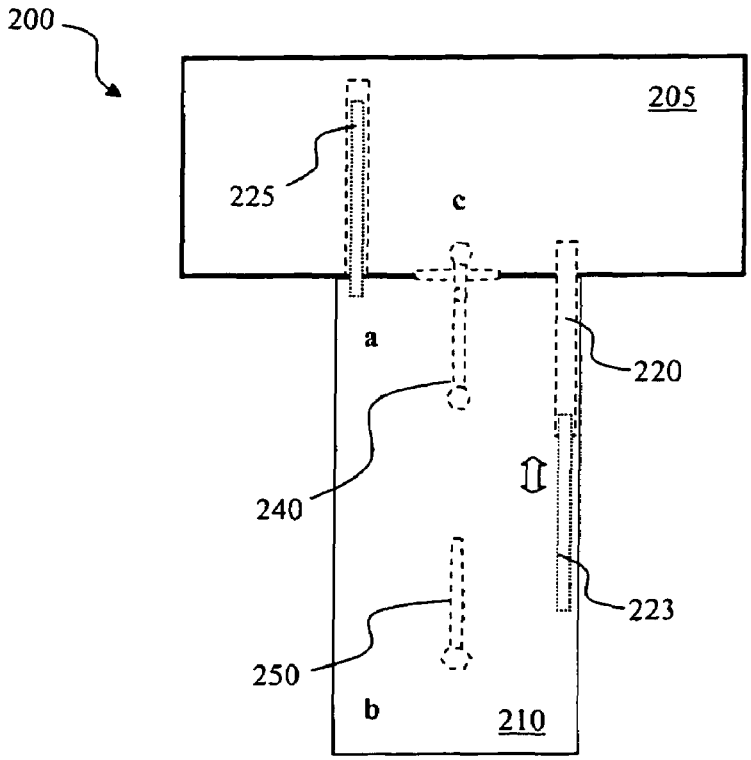
FIG. 11 illustrates a top view of a desk in FIG. 10 with the front panel in its fully deployed position wherein the front panel is situated with end "a" parallel with the front edge of the desk, indicated by "c", and end "b" deployed furthest away from the front of the desk indicated by "c", and one telescoping support member is shown in a stored position within the desk while another telescoping support member is shown deployed underneath the front panel as support for the front panel.

Referring to FIG. 11, a top view of the desk 200 and deployed front panel 210 are shown. The front panel is shown deployed wherein the edge of side "a" is held parallel with the front edge "c" of the desk top 205. Side "b" is shown located the furthest away from the desk top 205. The desk top 205 and front panel 210 together form a substantial workspace for more than two meeting collaborators. It should be appreciated by FIG. 11 that the front panel 210 can provide a temporary conference room table for use by meeting collaborators. Also shown in FIG. 11 is the general location of control hardware 240, support member 220 and support member 225. Support member 220 is shown fully extended. Because front panel 210 must extend a substantial distance from the desk 200 than the first embodiment described with respect to FIGS. 1-9, the support members 220/225 should preferably also extend in order to provide adequate support to the longer deployment of front panel 210. The support members 220/225 are therefore shown to include a telescoping configuration wherein, for example, a narrower support member 223/227 is stored within respective larger support member 220/225 during storage within the desk 200, but the narrower support member 223/227 can be extend further than the larger/wider support members 220/225 when are both fully extended.

Figure 15:
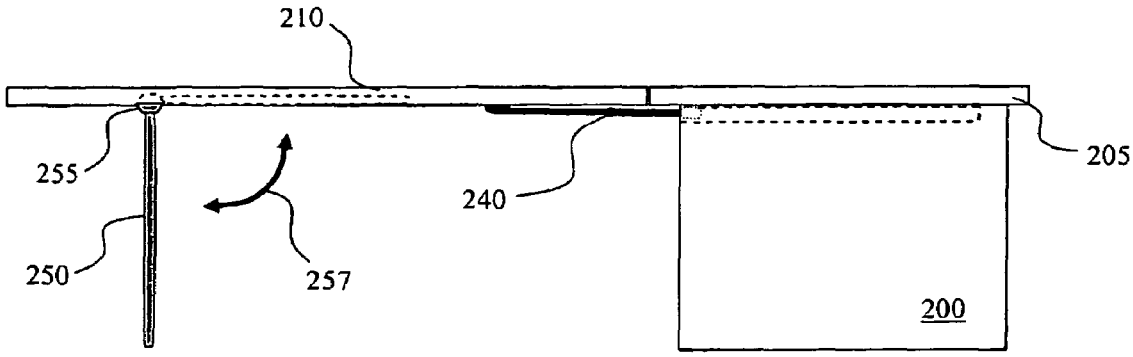
FIG. 15 illustrates another side view of the desk with the front panel deployed in an upright, horizontal position at the front of the desk, and control hardware is also shown by solid and dashed lines to be located under the front panel as support and partially located and secured within the desk even when deployed.

Also shown in FIG. 11 is an optional leg 250 that can be stored within the underside of front panel 210 when the front panel 110 is in storage position in front of desk 200. When the front panel 210 is fully deployed, however, the optional leg 250 can be deployed vertically (as shown in FIG. 15) to support the front panel 210 horizontally.

Figure 12:
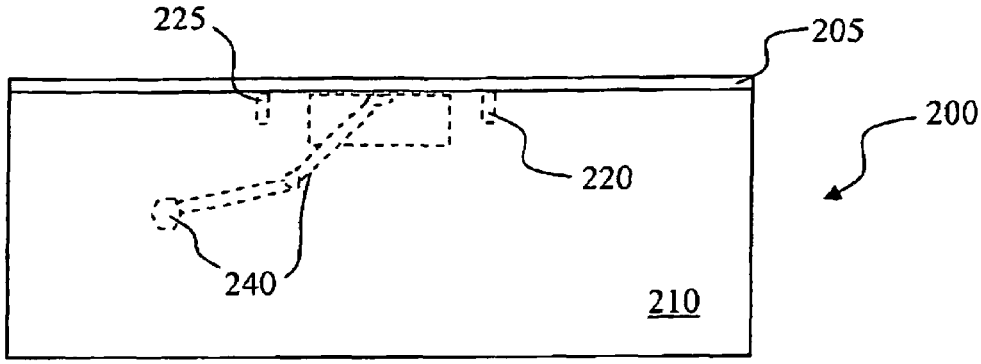
FIG. 12 illustrated a front view of the desk with the panel in its stored, vertical position and control hardware and support members are shown by dashed lines in storage position within the desk and underneath the desk top.

FIG. 12 illustrates a front view of the desk 200 with the front panel 210 in its stored, vertical position in front of desk 200. Also shown by dashed lines is the general location of control hardware 240 and support members 220/225 within the desk 200 and underneath the desk top 205.

Figure 13:
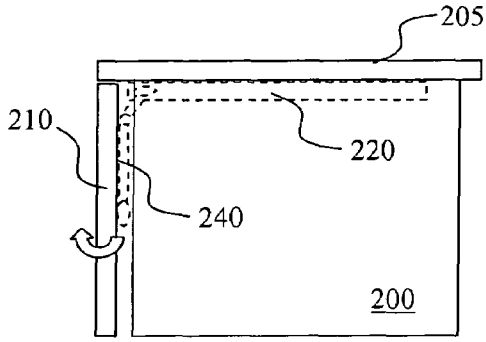
FIG. 13 illustrates a side view of the desk with the front panel situated in its storage position at the front of the desk, and control hardware and a support member are shown by dashed lines located under the desk top within the desk.

FIG. 13 illustrates a side view of the desk 200 with the front panel 210 situated in its storage position at the front of the desk 200, and control hardware 240 and a support member 220 are shown by dashed lines located under the desk top 205 within the desk 200.

Figure 14:
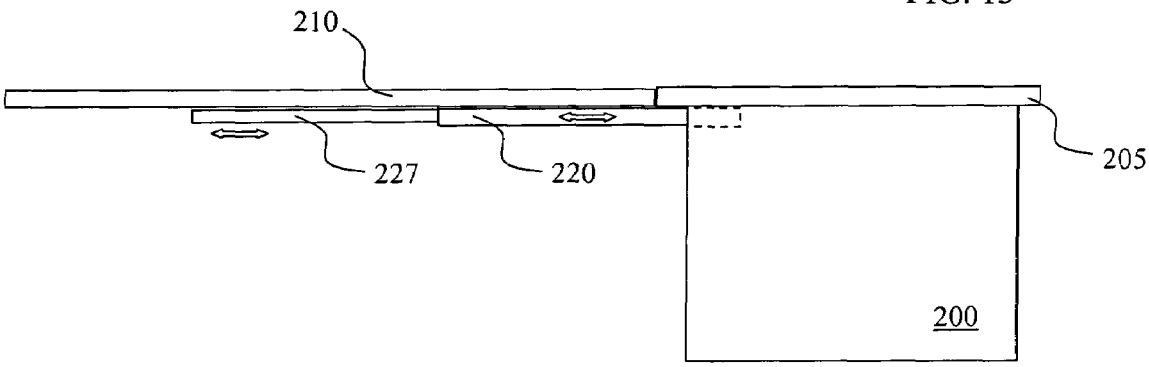
FIG. 14 illustrates a side view of the desk with the front panel deployed in an upright, horizontal, rotated position at the front of the desk, and a telescoping support member is shown also shown by solid and dashed lines to be located under the front panel as support and partially located within the desk even when deployed.

FIG. 14 illustrates a side view of the desk 200 with the front panel 210 deployed in an upright, horizontal, rotated position at the front of the desk 200, and a telescoping support member 220 is also shown by solid lines to be located under the front panel as support and by dashed lines to be partially located within the desk 200 even when deployed.

FIG. 15 illustrates another side view of the desk 200 of FIG. 14 with the front panel 210 fully deployed in an upright, horizontal, rotated position at the front of the desk 200, and control hardware 240 is also shown by solid and dashed lines to be located under the front panel 210 in support of the front panel 210, and also partially located within the desk 200 even when the front panel 210 is fully deployed.

Also shown in FIG. 15 is an optional leg 250 that can be deployed into a vertical position as shown in order to provide support to the front panel 210 when it is fully deployed. The leg 250 can be used in combination with telescoping support member 220 shown in FIG. 14. The leg can be secured by hardware 255 known in the art to enable rotational movement as shown by arrow 257. It should be appreciated that hardware should allow the leg to be swung into deployment and also back into storage. Preferably, the hardware for leg 250 will also firmly lock the leg into place when it is deployed or stored.

Figure 16:
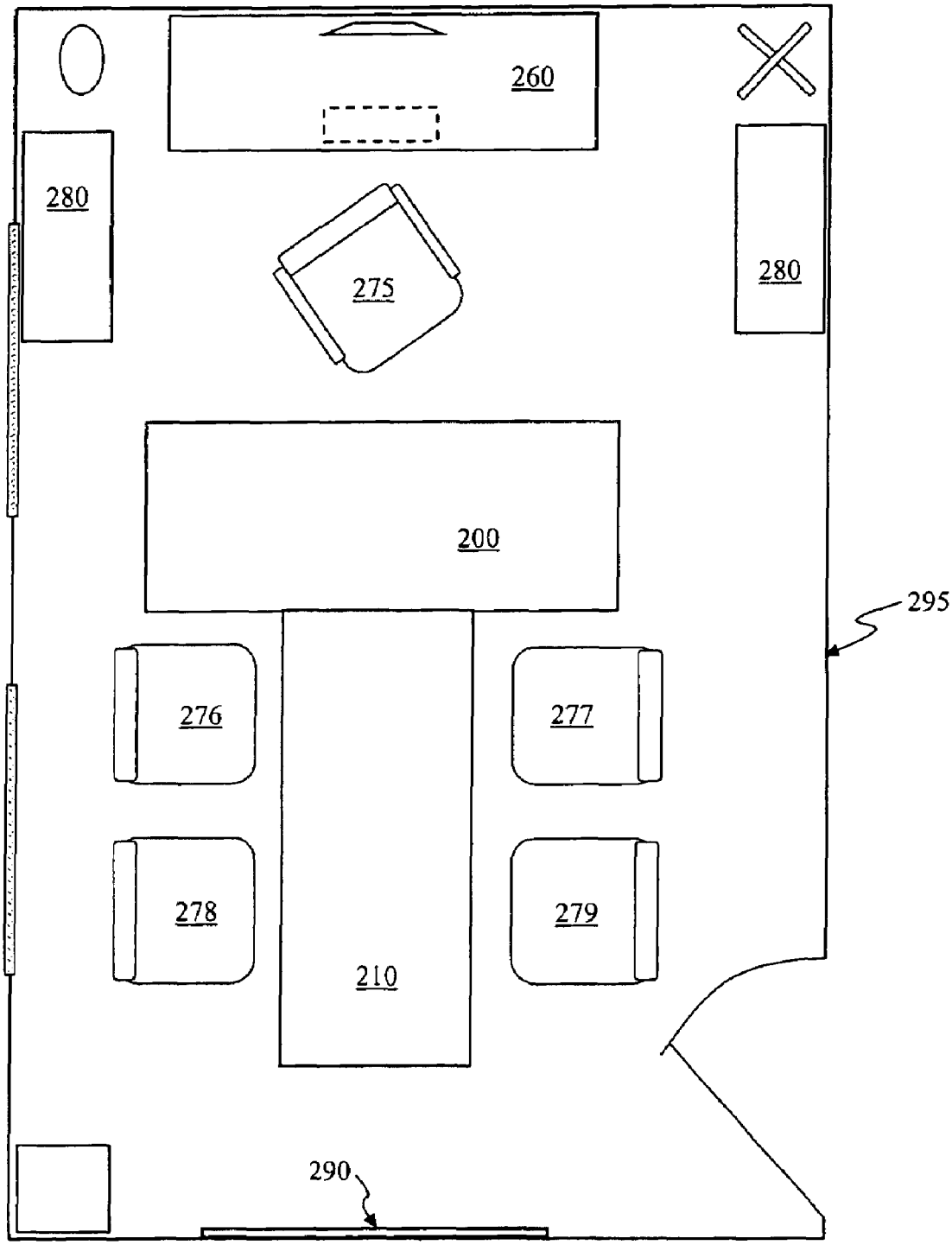
FIG. 16 illustrates the floor plan of a standard, private office wherein a desk equipped with a front panel deployed in an upright, rotated, horizontal position at the front of the desk, and other standard furnishing are also depicted.

Referring to FIG. 16, a top view of a floor plan for a typical office 295 is shown. Within the office 295 will commonly be found a computer work station/credenza 260, book shelves 280, an executive chair 275, and a dry erase/presentation/chalk board 290. The typical office will also have at least two visitor chairs 276/278. Where the present invention is utilized, however, a standard office 295 can now comfortably include two or more visiting participants in a working meeting or conference. Utilizing a desk 200 with a deployable front panel 210 as described in the second embodiment of the invention, chairs 276-279 can comfortably occupy users and provide the users with workspace to conduct a meaningful meeting with the office owner 275.

The invention claimed is:

1. An office furnishing, comprising:

an office desk adapted for use within a private office and adapted to enable an office desk user to provide additional desktop workspace and accommodate at least two additional participants in a private meeting within said private office, said office desk including a pair of opposing side panels, each side panel having a front end portion, a rear end portion, a top end portion and a bottom end portion, and a rectangular desktop panel horizontally disposed onto and attached near opposite width ends of said rectangular desktop panel to said top end portions of the opposing side panels, wherein opposite length ends of said rectangular desktop panel define a front of said office desk associated with a first length end of said rectangular top panel and a rear of said office desk associated with a second length of said rectangular desktop panel wherein the rear of said office desk has a cavity formed between said pair of opposing side panels and beneath the rectangular top panel wherein part of an office chair and user legs can be stowed;

at least one desk drawer movably installed at the rear of said desk beneath and centered within said rectangular desktop panel and between said pair of opposing side panels, said at least one desk drawer adapted to be moved from a closed storage position beneath said rectangular desktop panel into an opened access position located away from the rear of said desk and said closed storage position;

a rectangular front panel attached by control hardware along a first length end of said rectangular front panel to the front of said office desk near said first length end of said rectangular desktop panel, said rectangular front panel adapted to be stowed in a flat vertical position against the front of said office desk beneath said first length of said rectangular top panel when not required for the provision of additional office desktop workspace and wherefrom the rectangular front panel and said hardware is adapted to be rotated 90 degrees vertically and swung 90 degrees horizontally into a deployed horizontal position wherein one end of the front panel is located and touching near the front, center of the desktop and the opposite end is located furthest way from the front, center of the desk, thereby converting the desktop and the front panel into a T-shaped workspace for use by multiple collaborators, wherein said control hardware adapted to restrict movement speed by said rectangular front panel during its movement between stowed and deployed positions and adapted to enable the rectangular front panel to be physically manipulated into deployed or storage positions with respect to said office desk by a single user;

at least one support member movable from a storage location beneath said rectangular top panel into a supporting position beneath said rectangular front panel after said rectangular front panel is deployed into additional office desktop; and at least one leg stowed within the front panel and adapted to be swung ninety degrees into a supporting position at the opposite end of the front panel located furthest away from the front, center of the desk.

2. An office furnishing, comprising:

an office desk provided for use within a private office and adapted to enable an office desk user to provide additional desktop workspace and accommodate at least two participants in a meeting within said private office, said office desk including a pair of opposing side panels, each side panel having a front end portion, a rear end portion, a top end portion and a bottom end portion, and a rectangular desktop panel horizontally disposed onto and attached near opposite width ends of said rectangular desktop panel to said top end portions of the opposing side panels, wherein opposite length ends of said rectangular desktop panel define a front of said office desk associated with a first length end of said rectangular top panel and a rear of said office desk associated with a second length of said rectangular desktop panel wherein the rear of said office desk has a cavity formed between said pair of opposing side panels and beneath the rectangular top panel wherein part of an office chair and user legs can be stowed;

a rectangular front panel attached by control hardware along a first length end of said rectangular front panel to the front of said office desk near said first length end of said rectangular desktop panel, said rectangular front panel adapted to be stowed in a flat vertical position against the front of said office desk beneath said first length of said rectangular top panel when not required for the provision of additional office desktop workspace and wherefrom the rectangular front panel and said hardware is adapted to be rotated 90 degrees vertically and swung 90 degrees horizontally into a deployed horizontal position wherein one end of the front panel is located and touching near the front, center of the desktop and the opposite end is located furthest way from the front, center of the desk, thereby converting the desktop and the front panel into a T-shaped workspace for use by multiple collaborators, wherein said control hardware adapted to restrict movement speed between said rectangular front panel during its movement between stowed and deployed positions and adapted to enable the rectangular front panel to be physically manipulated into deployed or storage positions with respect to said office desk by a single user, whereby said rectangular front panel extends outwardly from and substantially level with said rectangular desktop panel;

at least one desk drawer movably installed at the rear of said desk directly beneath and center upon said rectangular desktop panel between said pair of opposing side panels, said at least one desk drawer adapted to be moved from a closed storage position beneath said rectangular desktop panel into an opened access position located away from the rear of said desk and said closed storage position;

two telescoping support members secured to said rectangular top panel and adapted to be slid horizontally from storage locations directly beneath said rectangular top panel between said at least one desk drawer and said pair of opposing side panels into a supporting position in front of said office desk and directly beneath said rectangular front panel whereon said two telescoping support members are adapted to make contact with and support said rectangular front panel after said rectangular front panel is deployed into additional horizontal meeting space; and at least one leg stowed within the front panel and adapted to be swung ninety degrees into a supporting position at the opposite end of the front panel located furthest away from the front, center of the desk.

3. A system adapted for providing private meeting and conference space for executives, a professionals and managers, comprising:

an office desk adapted for use with at least three chairs in a private office and adapted to enable an office desk user to provide additional desktop workspace for at least two additional participants engaged in a meeting with the office desk user around the office desk, said office desk further comprising a pair of opposing side panels, each side panel having a front end portion, a rear end portion, a top end portion and a bottom end portion, and a rectangular desktop panel horizontally disposed onto and attached near opposite width ends of said rectangular desktop panel to said top end portions of the opposing side panels, wherein opposite length ends of said rectangular desktop panel define a front of said office desk associated with a first length end of said rectangular top panel and a rear of said office desk associated with a second length of said rectangular desktop panel wherein the rear of said office desk has a cavity formed between said pair of opposing side panels and beneath the rectangular top panel wherein part of one of said at least three chairs and the office desk user's legs can be stowed during the meeting;

a drawer movably installed near the middle and at the rear of said desk beneath said rectangular desktop panel and between said pair of opposing side panels, said drawer adapted to be moved from a closed storage position beneath said rectangular desktop panel into an opened access position located away from the rear of said desk and said closed storage position;

a rectangular front panel attached by control hardware along a first length end of said rectangular front panel to the front of said office desk near said first length end of said rectangular desktop panel, said rectangular front panel adapted to be stowed in a flat vertical position against the front of said office desk beneath said first length of said rectangular top panel when not required for the provision of additional office desktop workspace for the at least two additional participants and wherefrom the rectangular front panel is further adapted to be rotated 90 degrees vertically and swung 90 degrees horizontally into a deployed horizontal position wherein one end of the front panel is located and touching near the front, center of the desktop and the opposite end is located furthest way from the front, center of the desk, thereby converting the desktop and the front panel into a T-shaped workspace for use by multiple collaborators, said control hardware further comprising at least one of spring loaded, hydraulic and pneumatic hardware adapted to restrict movement speed between said rectangular front panel during its movement between stowed and deployed positions and adapted to enable the rectangular front panel to be physically manipulated into deployed or storage positions with respect to said office desk by a single user, whereby said rectangular front panel extends outwardly from and substantially level with said rectangular desktop panel along their respective first length ends;

two telescoping support members adapted to be stowed in storage locations located beneath said rectangular top panel in-between said drawer and said pair of opposing side panels, said two telescoping support members secured to said rectangular top panel, wherein each of said telescoping support members are further adapted to be movable from the storage location into a supporting positions beneath said rectangular front panel after said rectangular front panel is deployed into additional horizontal meeting space;

a support structure located beneath said at least one telescoping support member and said rectangular desktop panel near the front of said office desk, said support structure adapted to provide support to said at least one telescoping support member when extended front underneath said rectangular desktop panel to provide support to said rectangular front panel when said rectangular front panel is deployed into said additional horizontal meeting space; and at least one leg stowed within the front panel and adapted to be swung ninety degrees into a supporting position at the opposite end of the front panel located furthest away from the front, center of the desk.

* * * * *